US005405724A

United States Patent [19]

Hsieh et al.

[11] Patent Number: 5,405,724

[45] Date of Patent: Apr. 11, 1995

[54] PHOTOCONDUCTIVE IMAGING MEMBERS AND PROCESSES THEREOF COMPRISING SOLUBILIZED PIGMENT-LEWIS ACID COMPLEXES

[75] Inventors: Bing R. Hsieh; Ian D. Morrison; Edward F. Grabowski, all of Webster; Andrew R. Melnyk, Rochester, all of N.Y.

[73] Assignee: Xerox Corporation, Stamford, Conn.

[21] Appl. No.: 28,010

[22] Filed: Mar. 8, 1993

[51] Int. Cl.[6] ..... G03G 15/02

[52] U.S. Cl. ..... 430/57; 430/59; 430/78; 524/600

[58] Field of Search ..... 430/59, 78, 57; 524/600

[56] References Cited

U.S. PATENT DOCUMENTS 4,514,482 4/1985 Loutfy et al. ..... 430/78
4,555,463 11/1985 Hor et al. ..... 430/59
4,587,189 5/1986 Hor et al. ..... 430/59
4,882,254 11/1989 Loutfy et al. ..... 430/59
4,945,156 7/1990 Jenekhe et al. ..... 528/485
4,963,616 10/1990 Jenekhe ..... 524/600

OTHER PUBLICATIONS

Jenekhe, Sampson A., and Johnson, Paul O., "Complexation-Mediated Solubilization and Processing of Rigid-Chain and Ladder Polymers in Apritic Organic Solvents Macromolecules", 1990, 23.

*Primary Examiner*—S. Rosasco
*Attorney, Agent, or Firm*—John L. Haack

[57] ABSTRACT

Disclosed is a process for forming thin films of pigment compounds, comprising providing a solubilized pigment-Lewis acid complex contained in an aprotic organic solvent system and coating the solubilized pigment-Lewis acid complex containing solvent system on a substrate.

29 Claims, 6 Drawing Sheets

PHOTOCONDUCTIVE IMAGING MEMBERS AND PROCESSES THEREOF COMPRISING SOLUBILIZED PIGMENT-LEWIS ACID COMPLEXES

BACKGROUND OF THE INVENTION

This invention is generally directed to molecularly dispersed pigments, the preparation of thin films containing molecularly dispersed pigments, and to imaging members thereof. More specifically, the present invention is directed to processes employing Lewis acid-pigment solubilization for fabricating solution coated photosensitive pigment layers, and photo- and opto-electronic devices and imaging members thereof. In embodiments of the present invention, there are provided layered photoconductive imaging members with improved xerographic properties, inclusive of high charge acceptance, low dark decay, high photosensitivity in the wavelength regions of from about 400 to about 900 nanometers, and maximum or peak photosensitivity in the wavelength regions of from about 600 to about 800 nanometers, enabling their selection for electrophotographic, especially xerographic, imaging systems and printers sensitive to near infrared wavelengths. In embodiments of the invention of the present application, there are provided imaging members with photoconductive layers comprised of molecularly dispersed pigments illustrated herein, and charge or hole transport layers, especially those comprised of aryl amines, which members are sensitive to light in the wavelength region of from about 700 to about 820 nanometers. The resulting members are responsive to red illumination originating from light emitting diode (LED) printing apparatuses. Imaging members prepared by processes of the present invention can be used in, or in conjunction with, optoelectronic devices such as light emitting diodes, organic electroluminescent emitters, field effect transistors, vacuum fluorescent displays, thin film transistors, and liquid crystal displays. The photoresponsive imaging members of the present invention can contain, for example, situated between a photogenerating layer and a charge transporting layer, or situated between a photogenerating layer and a supporting substrate with a charge transport layer in contact with the photogenerating layer, a photoconductive composition comprised of the molecularly dispersed photogenerating pigments as illustrated herein.

In embodiments of the present invention, there are provided alternative and simplified processes, dissimilar than traditional high energy pigment attrition and high vacuum pigment sublimation processes, for the fabrication of pigment containing photosensitive layered devices. Known pigment attrition processes involves reduction of pigment particle size by high energy grinding or attrition typically conducted in a dispersion medium. The resulting pigment dispersion is then used to cast pigmented layers on selected substrates by, for example, spray, dip, spin, and the like, coating techniques. Although fine pigment particles can be obtained by prolonged attrition processing, the resulting pigment dispersions often reagglomerate in time. A wide variety of pigment dispersants have been employed to avoid rapid aggregate formation with different varying degrees of success. A binder resin, which may be solubilized in the molecular pigment dispersion and/or precoated onto the substrates, is optionally used to provide necessary mechanical strength for the deposited pigment layer or layers. Pigment sublimation processes involve heating pigment particles under high vacuum to vaporize the pigment molecules which are then condensed onto cooled substrates to form a pigment layer. Pure pigment layers with high degree of uniformity are achievable by the sublimation process. However, sublimation processing may be a complicated and expensive proposition for large scale production operations. Processes are also known for the preparation and purification of photosensitive pigments involving sequential dissolution and reprecipitation of the pigment using, for example, an organic or inorganic acid solvent system followed by a non solvent system as disclosed, for example, in U.S. Pat. Nos. 5, 153,094 and 5,153,313. However, the pigment solutions disclosed in these patents have not been used directly in the preparation of photogenerating layers. Major disadvantages of using strong acid solvent solutions for larger scale production of films of photoconductive pigments include the highly corrosive and toxic nature of the acidic solvents; and acid solvents are generally not sufficiently volatile and are difficult to remove from the films.

In embodiments of the present invention, there are provided imaging members with a photoconductive layer comprised of the molecularly dispersed pigments as illustrated herein, that is, an imaging member with a layer that functions simultaneously both as charge generating layer and transport layer.

Certain layered imaging members are known, including those comprised of separate generating layers, and transport layers as described in U.S. Pat. No. 4,265,990; and overcoated photoresponsive materials containing a hole injecting layer overcoated with a hole transport layer, followed by an overcoating of a photogenerating layer; and a top coating of an insulating organic resin, reference U.S. Pat. No. 4,251,612. Examples of photogenerating layers disclosed in these patents include trigonal selenium and phthalocyanines, while examples of transport layers include certain diamines as mentioned therein.

The following United States patents are mentioned: 4,299,896 which discloses imaging members with a photosensitive layer selected from the disazo pigments of the formulas illustrated, for example, in the Abstract, and in column 2; 4,314,015 wherein the disazo pigments for the imaging member are of the formula as illustrated in the Abstract, for example, and column 2; 4,666,810 wherein the azo pigments are illustrated in column 2 for example; and 4,797,337 wherein the disazo photogenerating pigment is of the formula as illustrated in the Abstract, for example, which disazos may contain a $SO_2$ group.

U.S. Pat. No. 4,713,307, discloses photoconductive imaging members containing a supporting substrate, certain azo pigments as photogenerating materials, and a hole transport layer that preferably contains an aryl diamine compound dispersed in an inactive resinous binder.

U.S. Pat. No. 4,797,337, discloses a photoconductive imaging member comprising a supporting substrate, a hole transport layer, and a photogenerating layer comprising specific disazo compounds.

Additional references illustrating layered organic electrophotographic photoconductor elements with azo, bisazo, and related compounds include U.S. Pat. No. 4,390,611, U.S. Pat. No. 4,551,404, U.S. Pat. No. 4,596,754, Japanese Patent 60-64354, U.S. Pat. No.

4,400,455, U.S. Pat. No. 4,390,608, U.S. Pat. No. 4,327,168, U.S. Pat. No. 4,299,896, U.S. Pat. No. 4,314,015, U.S. Pat. No. 4,486,522, U.S. Pat. No. 4,486,519, U.S. Pat. No. 4,555,667, U.S. Pat. No. 4,440,845, U.S. Pat. No. 4,486,800, U.S. Pat. No. 4,309,611, U.S. Pat. No. 4,418,133, U.S. Pat. No. 4,293,628, U.S. Pat. No. 4,427,753, U.S. Pat. No. 4,495,264, U.S. Pat. No. 4,359,513, U.S. Pat. No. 3,898,084, U.S. Pat. No. 4,830,944, U.S. Pat. No. 4,820,602, and Japanese Patent Publication 60-111247.

U.S. Pat. No. 4,755,443 discloses a photoreceptor for electrophotography which comprises a charge carrier generating material and charge transport material wherein one charge generating material is a metal phthalocyanine or a metal-free phthalocyanine. The layer containing the generator material also contains an organic amine. Other carrier generating substances can be used in combination with the phthalocyanine generator material, including azo pigments, anthraquinone dyes, perylene dyes, polycyclic quinone dyes, and methine stearate pigments.

U.S. Pat. No. 4,424,266 discloses an electrophotographic photosensitive element having a conductive support and a photosensitive layer comprising a carrier generating phase layer containing a carrier generating material selected from the group consisting of perylene dyes, polycyclic quinones, and azo dyes, and a carrier transporting phase layer containing a hydrazone carrier transporting material. The carrier generator materials can be used either singly or in combination.

U.S. Pat. No. 4,882,254, discloses a layered photoresponsive imaging member which comprises a supporting substrate, a photogenerator layer comprising a mixture of first and second pigments, and an aryl amine hole transport layer. The mixture of pigments is selected from perylenes and phthalocyanines, polycyclic quinones and phthalocyanines, or perinones and phthalocyanines.

Photoresponsive imaging members containing perinone and perylene compounds are also known. For example, European Patent Publication 0040402, DE3019326, filed May 21, 1980, discloses the use of N,N'-disubstituted perylene-3,4,9,10-tetracarboxyldiimide pigments as photoconductive substances.

Imaging members with phthalocyanine materials are also known as disclosed in, for example, U.S. Pat. No. 3,594,163, U.S. Pat. No. 3,657,272, U.S. Pat. No. 3,816,118, U.S. Pat. No. 3,862,127, U.S. Pat. No. 3,903,107, U.S. Pat. No. 3,927,026, U.S. Pat. No. 3,932,180, U.S. Pat. No. 3,932,454, U.S. Pat. No. 4,031,109, U.S. Pat. No. 4,098,795, and U.S. Patent Re. 27,117.

Processes for preparing imaging members by dispersion or suspension methodology are disclosed in U.S. Pat. Nos. 4,514,482, 4,555,463 and 4,587,189.

The disclosures of each of the above mentioned patents and publications are totally incorporated herein by reference.

Imaging members and processes thereof are illustrated in copending applications U.S. Ser. No. 08/011,590 (D/92578, Abkowitz) filed Feb. 1, 1993, and U.S. Ser. No. 07/844,085 (D/91668), filed Mar. 2, 1992, the disclosures of which are totally incorporated herein by reference.

SUMMARY OF THE INVENTION

It is an object of the present invention to provide single layer and multilayered imaging members with many of the advantages illustrated herein.

Another object of the present invention is to provide certain photoconductive and photogenerating pigments in a molecularly dispersed state, and imaging members thereof, which members can be sensitive to wavelengths of from about 400 to about 900 and preferably from about 600 to about 800 nanometers.

In another object of the present invention there are provided photoconductive and photogenerating molecularly dispersed pigments and imaging members thereof, which members are substantially insensitive to visible light from about 400 to about 700 nanometers.

Another object of the present invention resides in the provision of layered photoresponsive imaging members which can possess excellent dark decay properties, high charge acceptance values, and high electrical stability.

Still another object of the present invention resides in providing a process for forming thin films of pigment compounds, comprising providing a solubilized pigment-Lewis acid complex contained in an aprotic organic solvent system and coating the solubilized pigment-Lewis acid complex containing solvent system on a substrate Further, in another object of the present invention there are provided photoconductive imaging members that can be responsive to radiation from LED and related devices.

Additionally, another object of the present invention resides in the provision of imaging and printing methods with the photoconductive imaging members illustrated herein.

It is an object of the present invention to provide processes for solubilizing pigment particles into aprotic low boiling organic solvents containing Lewis acids.

In another object of the present invention to provide a process whereby the resulting solubilized pigment solutions are used to solvent coat pigment layers or films onto selected substrates or objects.

Another object of the present invention is to provide a solution containing a solubilized pigment complex or complexes for coating a pigmented layer or layers of desired thicknesses onto selected substrates.

Another object of the present invention is to provide complexed pigment solutions which contain a mixture of two or more solubilized pigments for coating a mixed pigment layer or layers on a selected substrate.

In yet another object of the present invention in embodiments there are provided layered imaging members with a substantially uniform, amorphous, nonparticulate photoconductive or photogenerating layer, thereby minimizing, or avoiding final print defects in, for example, high resolution and high speed xerography.

In embodiments, the present invention provides a process for forming thin films of pigment compounds, of a class normally insoluble in aprotic organic solvents. The films are prepared in process embodiments from a solubilized pigment-Lewis acid complex contained in an aprotic organic solvent system which processes comprise coating the solubilized pigment-Lewis acid complex containing solvent system on a substrate, drying, and removing the Lewis acid.

The present invention also provides a process for preparing a photoconductive imaging member comprising: providing a solution comprised of a solubilized pigment-Lewis acid complex, optionally a binder resin, and a polar aprotic solvent system; coating the solution onto a substrate to form a thin film or coating layer on the substrate; drying the thin film or coating layer on the substrate; washing the dry film layer with a protic solvent system to remove the Lewis acid; drying the washed coated substrate; and optionally applying a charge transporting layer and or a protective overcoating layer to the coated substrate.

In a preferred embodiment, photoconductive imaging members of the present invention are comprised of a supporting substrate, and a photogenerating layer in contact therewith comprised of a molecularly dispersed pigment or pigment mixture prepared as illustrated and selected from the group consisting of metal phthalocyanines, oligomeric phtholocyanines, metal-free phthalocyanines, quinacridones, Monastral Violet and Monastral Red Y, substituted 2,4-diamino-triazines, squaraines, polynuclear aromatic quinones, and thiopyrylium compounds.

The pigment solubilization processes of the present invention using a pigment or mixture of pigments, a Lewis acid and a nonprotic or aprotic solvent are generally applicable to pigments such as quinacridones, phthalocyanines, azo and polyazo, squarylium, cyanine pigments, and the like, that are rich in pi-electrons or electron donating heteroatoms, for example, nitrogen, sulfur, oxygen and other group VA and VIA chemical elements in the periodic table, and that are capable of coordinating with certain electron acceptors such as Lewis acids, for example, as selected from the group consisting of $AlCl_3$, $GaCl_3$, $FeCl_3$, $InCl_3$, $SnCl_4$, $BF_3$, $ZnCl_2$, $TiCl_4$, $SbCl_3$, $SbCl_5$, $CuCl_2$, $SbF_5$, $VCl_4$, $TaCl_5$, $ZrCl_4$, $AsF_3$, and the like, and mixtures thereof. Lewis acid molecules readily coordinate with electron rich or electron donating heteroatoms or pi-electrons of the pigment molecules to form metal-pigment complexes that are soluble in selected polar aprotic solvents. The pigment solubilization process of the present invention is analogous in embodiments to solubilization of heterocyclic ladder and rigid rod polymers by Lewis acids as described, for example, by Jenekhe in U.S. Pat. Nos. 4,945,156 and 4,963,616 and by Jenekhe and Johnson in *Macromolecules*, 23, 4419 (1990) and references therein, particularly references 16 to 24, the disclosures of which are totally incorporated herein by reference. In addition, the molecularly dispersed pigment thin films of the present invention may be prepared and characterized by the methodology described in the aforementioned Jeneke references.

The solubilization processing of pigments of the present invention can be comprised of a one step or two steps that provides a solution comprised of pigment, a Lewis acid, and a polar aprotic solvent. In the one step operation, pigment complex formation and solubilization take place simultaneously or concurrently. In the two step operation, the first step involves forming a solid pigment-metaloid complex resulting from any suitable complexation reaction. A second step involves solubilization of the solid complex in a suitable organic solvent. A related two step process is described in U.S. Pat. No. 4,963,616, column 10, line 4, the disclosure of which is incorporated by reference herein in its entirety. The resulting solutions obtained from either the one step or two step solubilization operation contain soluble pigment complexes that can then be used to solvent coat pigmented layer or layers onto selected substrates, by means, for example, of spray, spin, dip, and the like, coating techniques.

Photoconductive imaging members in accordance with the present invention contain a pigment or pigment mixture as a photogenerating substance present in an amount of 0.5 to 100 percent by weight of the charge or photogenerating layer and wherein the pigment mixture contains at least a first pigment of from about 10 to about 50 weight percent of the pigment mixture and a second pigment of from about 40 to about 90 weight percent of the pigment mixture.

Typical organic photoconductive pigments include titanyl and vanadyl phthalocyanine and other phthalocyanine compounds, metal-free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, squaraine pigments, polynuclear aromatic quinones available from Allied Chemical Corporation under the tradename Indofast Double Scarlet, Indofast Violet Lake B, Indofast Brilliant Scarlet and Indofast Orange, thiopyrylium pigments, and the like, and mixtures thereof.

Lewis acids generally are electron acceptors which can combine with a donor molecule or ion by forming a coordinated chemical bond with two electrons from the donor molecule or ion. Typical Lewis acids include aluminum trichloride, $AlCl_3$, ferric trichloride, $FeCl_3$, stannic tetrachloride, $SnCl_4$, boron trifluoride, $BF_3$, $ZnCl_2$, $TiCl_4$, $SbCl_5$, $CuCl_2$, $SbF_5$, $VCl_4$, $TaCl_5$, $ZrCl_4$, and the like, and mixtures thereof. Other suitable complexing agents include nitrosyl ($NO^+$) salts, $NO^+A^-$ where $A=BF_4$, $HSO_4$, $PF_6$, $SbCl_6$, $AsF_6$, and the like. The Lewis acids or other complexing agents selected should preferably be soluble in polar aprotic solvents and dissolve, react with or controllably decompose in protic solvents.

A polar aprotic solvent or mixture of polar aprotic solvents can be used for the preparation of the pigment complex solution of the present invention. The use of a mixture of about two to about 10 solvents can modify the solubilization behaviors of the pigment particles. The aggregation behavior of the solubilized pigment molecules, the viscosity of the resulting solution mixtures, and the morphological and electrical properties of the resulting pigmented layer or layers may also be influenced by the choice of solvent or solvents used in the solubilization process. A suitable polar aprotic solvent in embodiments may be selected from the group nitromethane, nitroethane, 1-nitropropane, 1,2-dichloroethane methylene chloride, benzene, toluene, and the like, and mixtures thereof. Additional useful solvents are disclosed, for example, in the aforementioned U.S. Pat. No. 4,963,616, column 8, line 54.

One to about 10 binder resins may be present in the pigment Lewis acid complex solution, in solubilized and or dispersed in colloidal form. Another binder resin, which may be the same or different to those used in the complexed pigment solution, can also be precoated as a thin film on the selected substrate prior to the deposition of the pigment complex containing solution. A binder resin is optionally used to impart desired mechanical properties to the deposited pigment layer or layers and to provide an adhesive property for subsequently deposited layers. A binder resin may also be used to modify the viscosity of the complexed pigment solution to improve the coating processes and to modify the morphology and electrical properties of the deposited pigment layers. A binder resin or mixture of resins may be used in amounts of from about 0.1 to about 99.8 percent by weight of the total weight of the molecularly dispersed pigment charge generating layer.

Any suitable resin binder material may be employed in the charge generator layer. Typical organic resinous binders include polycarbonates, acrylate polymers, vinyl polymers, polyvinylcarbazole, polyesters, polysiloxanes, polyamides, polyurethanes, epoxies, and the like, and mixtures thereof, as disclosed in U.S. Pat. No. No. 3,121,006 and U.S. Pat. No. 4,439,507, the entire disclosures of which are incorporated herein by reference. Organic resinous polymers may be block, random or alternating copolymers.

The photogenerating layer containing photoconductive pigments, and the resinous binder material generally range in thickness of from about 0.1 micrometer to about 5.0 micrometers, and preferably has a thickness of from about 0.3 micrometer to about 3 micrometers. Other thicknesses may be selected such that the objects of the present invention are achieved.

Complexed pigment solutions may optionally contain a mixture of two to about 10 solubilized pigments for coating a mixed pigment layer or layers on a selected substrate. For example, a mixed pigment complex solution of benzimidazole perylene and titanyl phthalocyanine can be prepared for solvent coating in embodiments of the present invention to form a mixed molecular dispersion of pigments in a single layer. In addition, a plurality of solutions containing different mixtures of complexed pigments may be coated or deposited layerwise as disclosed herein to provide devices useful, for example, in imaging processes with unique mutilayer architectures. For example, a benzimidazole perylene-Lewis acid complex solution and a titanyl phthalocyanine-lewis acid complex solution can be independently prepared and then used to sequentially coat and form a device with, for example, alternating layers of the aforementioned dissimilar pigments.

The aforementioned molecularly dispersed pigments may be doped in amounts of from about 0.01 to about 50 weight percent of the total weight of the pigment with either p or n type components known in the semiconductor art, including for example $I_2$, $AsF_5$, $FeCl_3$, K, and the like, to impart desired conductivities thereof.

Also, the present invention in embodiments thereof can be accomplished by the provision of single layer or multilayered imaging members thereof. More specifically, the present invention is directed to photoconductive imaging members with a photoconductive pigment such as benzimidazole perylene and its analogues, perylene tetracarboxyl diimide derivatives, quinacridone derivatives, polyazo pigments, and phthalocyanine compounds, including oligomeric phthalocyanines, and mixtures thereof. Examples of photogenerating pigments that may be solubilized, completely or partially, in organic solvents in the presence of Lewis acids to fabricate imaging members of the present invention include those of formulae illustrated in FIGS. 7 to 9. Other suitable photoconductive pigments are described by K. Y. Law in, for example, "Organic Photoconductors: Recent Trends and Developments," *Chemical Reviews*, Vol. 93, No. 1 (1993), Jan/Feb, the disclosure of which is incorporated by reference herein in its entirety.

A general description of the fabrication of molecular dispersed pigment layers of the present invention in embodiments comprises: providing a pigment-Lewis acid complex solution by mixing a pigment and a Lewis acid in a low boiling organic solvent such as nitromethane, chloroform, methylene chloride and the like; coating the complex solution onto a substrate; drying the resulting coating; and removing substantial amounts of the Lewis acid by, for example, washing.

In other embodiments, processes for preparing imaging members having molecularly dispersed pigments comprise: providing a pigment-Lewis acid complex solution by mixing a pigment and a Lewis acid in a low boiling organic solvent containing optionally a binder resin; casting or coating the pigment-Lewis acid complex solution into a film or layer; removing residual solvent, by for example, evaporation; and washing the film or layer with a polar protic solvent such as water, methanol, ethanol, propanol, iso-propanol, acetic acid and mixtures thereof, in admixture with, for example, formamide, acetone, acetonitrile, dimethylformamide, N-methyl-2-pyrrolidone, and mixtures thereof to decompose, dissolve and subsequently remove substantial amounts of the Lewis acid component from the pigmented layer or film. A suitable pigment weight percent in a pigment-complex solution is from about 0.005 to about 20 percent, and preferably from about 1 to about 10 percent. The molar ratio of Lewis acid or Lewis acid molecule mixture to pigment molecules is preferably equal to, or greater than, the number of electron donating elements present in the pigment molecule. In embodiments, the molar ratio of Lewis acid to pigment used in forming Lewis acid-pigment complexes is of from about 1:1 to about 20:1.

Thin films were conveniently prepared for characterization by spin coating onto glass substrates from dilute solutions, for example, 1.0 to 2 weight percent, of a Lewis acid complexed pigment solubilized in, for example, nitromethane and methylene chloride.

The resulting molecularly dispersed pigments, as solutions or as thin films, were characterized by known means of, for example, intrinsic viscosity, thermogravimetric analysis, infrared spectra, or electronic absorption spectra.

The resulting molecularly dispersed pigment layers prepared by processes of the present invention were found to contain trace amounts of Lewis acid species which were measurable by energy dispersive X-ray analysis and related spectroscopic means. Residual Lewis acid derived ions remaining in thin films or layers may range from about 10 to about 10,000 parts per million depending on preparative procedures selected.

In one embodiment, there is envisioned a layered photoresponsive member comprised of a supporting substrate, a photoconductive layer comprised of the molecularly dispersed pigments illustrated herein, and situated between the supporting substrate, and the photoconductive layer a charge transport layer. In one specific illustrative embodiment, the photoresponsive device can be comprised of (1) a supporting substrate, (2) a hole blocking layer, (3) an optional adhesive interface layer, (4) a photogenerating layer comprised of a molecularly dispersed pigment, or mixtures thereof, (5) a charge transport layer, and (6) optionally a protective overcoat layer. Thus, a specific photoresponsive device of the present invention can be comprised of a conductive supporting substrate, a hole blocking metal oxide layer in contact therewith, an adhesive layer, a photogenerating layer comprised of a molecularly dispersed pigment or pigment mixture, respectively, overcoated on the optional adhesive layer, and as a top layer a hole transport layer comprised of certain diamines dispersed in a resinous matrix. The photoconductive layer composition when in contact with the hole transport layer is capable of allowing holes generated by the photogenerating layer to be transported. Examples of aryl amine hole transport molecules that may be selected for the photoconductor devices are illustrated in U.S. Pat. No. 4,265,990, the disclosure of which is totally incorporated herein by reference. Also, examples of charge transport molecules are illustrated in U.S. Pat. No. 4,921,773 and the patents mentioned therein, the disclosures of each of the aforementioned patents, including the '773 patent, being totally incorporated herein by reference.

Another advantage of using molecularly dispersed pigments as charge generators includes the ability to form a charge generation layer that is homogeneous and if desired, nonparticulate. A charge generator layer that is homogeneous and nonparticulate eliminates irreproducibilities associated with the particulate nature of the generation layer, for example, the stability of the coating dispersions, particle size, distribution of particle sizes, and the way conventional charge generator pigment particles organize themselves during coating and curing processes. Organization of particles may affect the charge migration process. Charge generation layers prepared from molecularly dispersed pigments of the present invention exhibit substantially none of the disadvantages associated with inhomogenous and particulate generator layers.

The photoresponsive devices described herein can be incorporated into various imaging systems such as those conventionally known as xerographic imaging processes. Additionally, the imaging members of the present invention can be selected for imaging and printing systems with near red and/or infrared light. In this embodiment, the photoresponsive devices may be negatively or positively charged, exposed to light in a wavelength of from about 400 to about 900, and preferably 600 to 800 nanometers, either sequentially or simultaneously, followed by developing the resulting image and transferring to paper. Additionally, the imaging members of the present invention can be selected for imaging and printing systems with visible light. In this embodiment, the photoresponsive devices may be negatively or positively charged, exposed to light in a wavelength of from about 400 to about 700 nanometers. The molecularly dispersed pigments may optionally be chosen so as to be insensitive in this region and therefore would not participate in the charge generation process thereby enabling multiple exposure light selective imaging processes.

BRIEF DESCRIPTION OF THE FIGURES

For a further understanding of the the present invention, the following detailed description of various embodiments is provided wherein.

DESCRIPTION OF SPECIFIC EMBODIMENTS

Specific embodiments of the invention will now be illustrated, it being noted that substantially equivalent imaging members are also embraced within the scope of the present invention.

Figure 1:
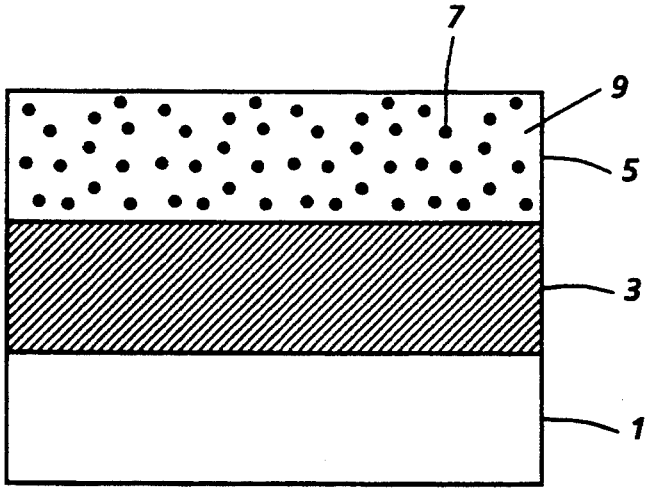
FIGS. 1, 2 and 3 are partially schematic views of examples of photoconductive imaging members of the present invention.
Figure 7:
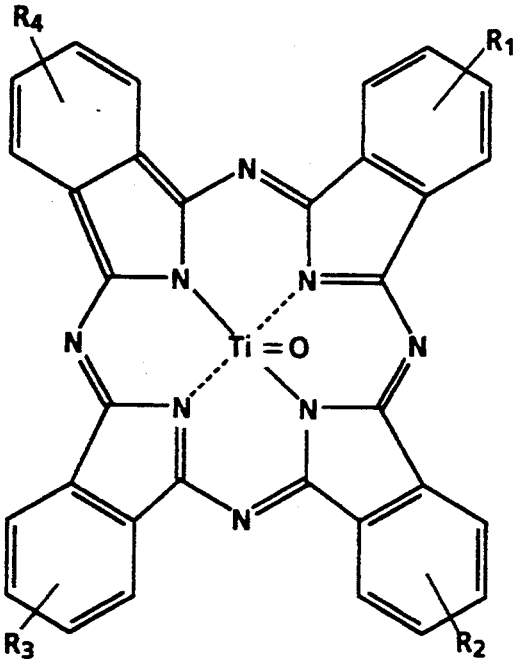
FIGS. 7 to 9 are chemical formulas representative of molecularly dispersible pigment compounds useful for Lewis acid complexation processes of the present invention and where certain pigment compounds possessing structural isomers may contain pure isomers or contain mixtures of both cis and trans (E and Z) isomeric segments as indicated in embodiments. The substituents represented by R may be any suitable radical provided the objects of the present invention are achieved.
Figure 8:
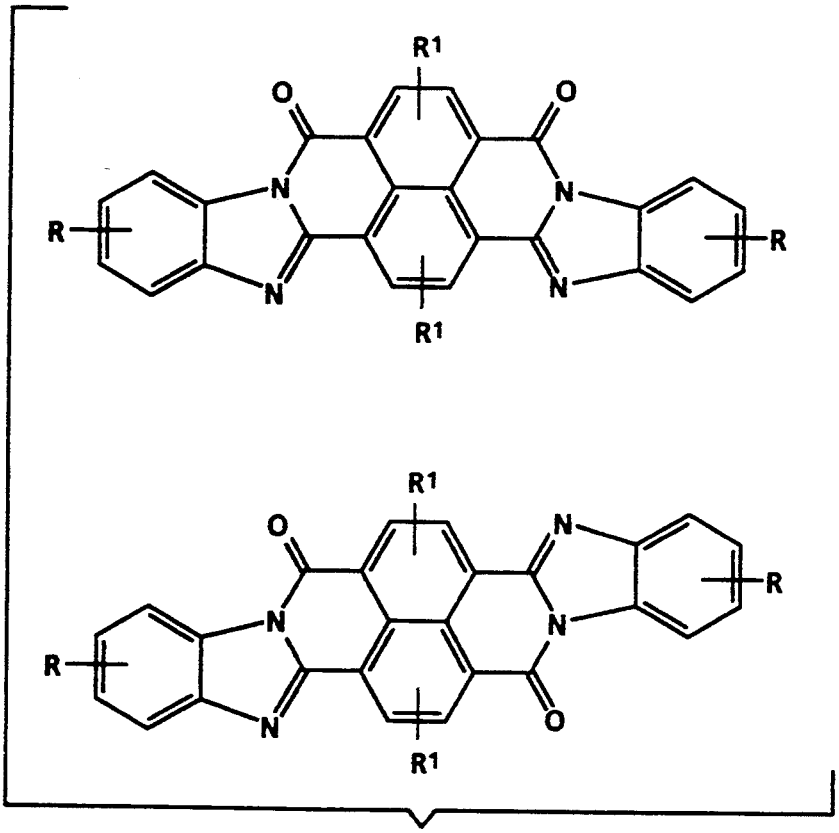
Figure 9:
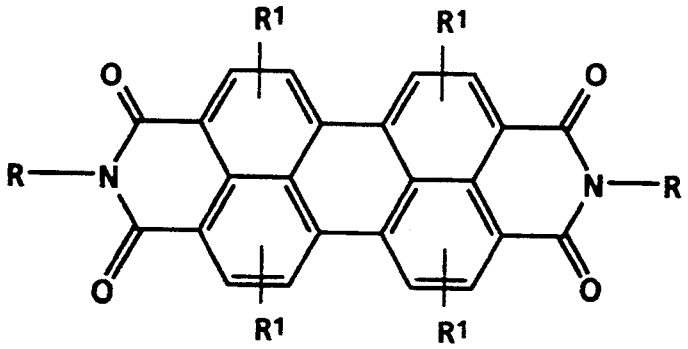

FIG. 1 illustrates a photoconductive imaging member of the present invention comprising a supporting substrate 1, a photogenerating layer 3 comprised of a molecularly dispersed pigment or molecularly dispersed pigment mixtures selected in embodiments from the formulas shown in FIG. 7 through 9, and preferably the formulas of FIG. 7 or 8 as illustrated herein, and an optional charge carrier hole transport layer 5, which comprises hole charge transporting molecules 7 dispersed in an inactive resinous binder composition 9. Layer 5 can be comprised solely of an optional hole transporting polymer, such as poly(methylphenylsilylene), poly(arylamine carbonates), poly(ether carbonates), and the like.

Figure 2:
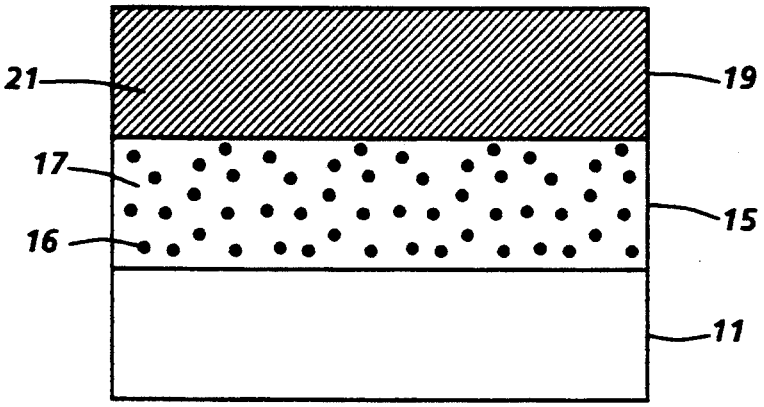

FIG. 2 illustrates essentially the same member as that shown in FIG. 1 with the exception that the hole transport layer is situated between the supporting substrate and the photogenerating layer. More specifically, this Figure illustrates a photoconductive imaging member comprising a supporting substrate 11, a hole transport layer 15 comprising aryl amine hole transport molecules 16 dispersed in an inactive resinous binder composition 17, and a photogenerating layer 19 comprising the molecularly dispersed pigments or pigment compound 21 of the formula of FIG. 7 as illustrated herein, especially those as represented by FIGS. 7 or 8, or mixtures thereof.

Figure 3:
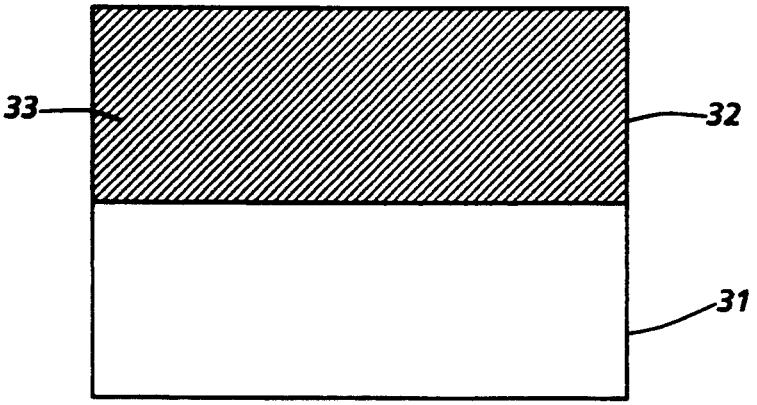

FIG. 3 illustrates a photoconductive imaging member of the present invention comprising a supporting substrate 31, a photoconductive layer 32 comprising the molecularly dispersed pigment 33, and an optional (not shown) charge transport layer 35 comprised of aryl diamine molecules 36 dispersed in a MAKROLON® polycarbonate binder 37.

Figure 4:
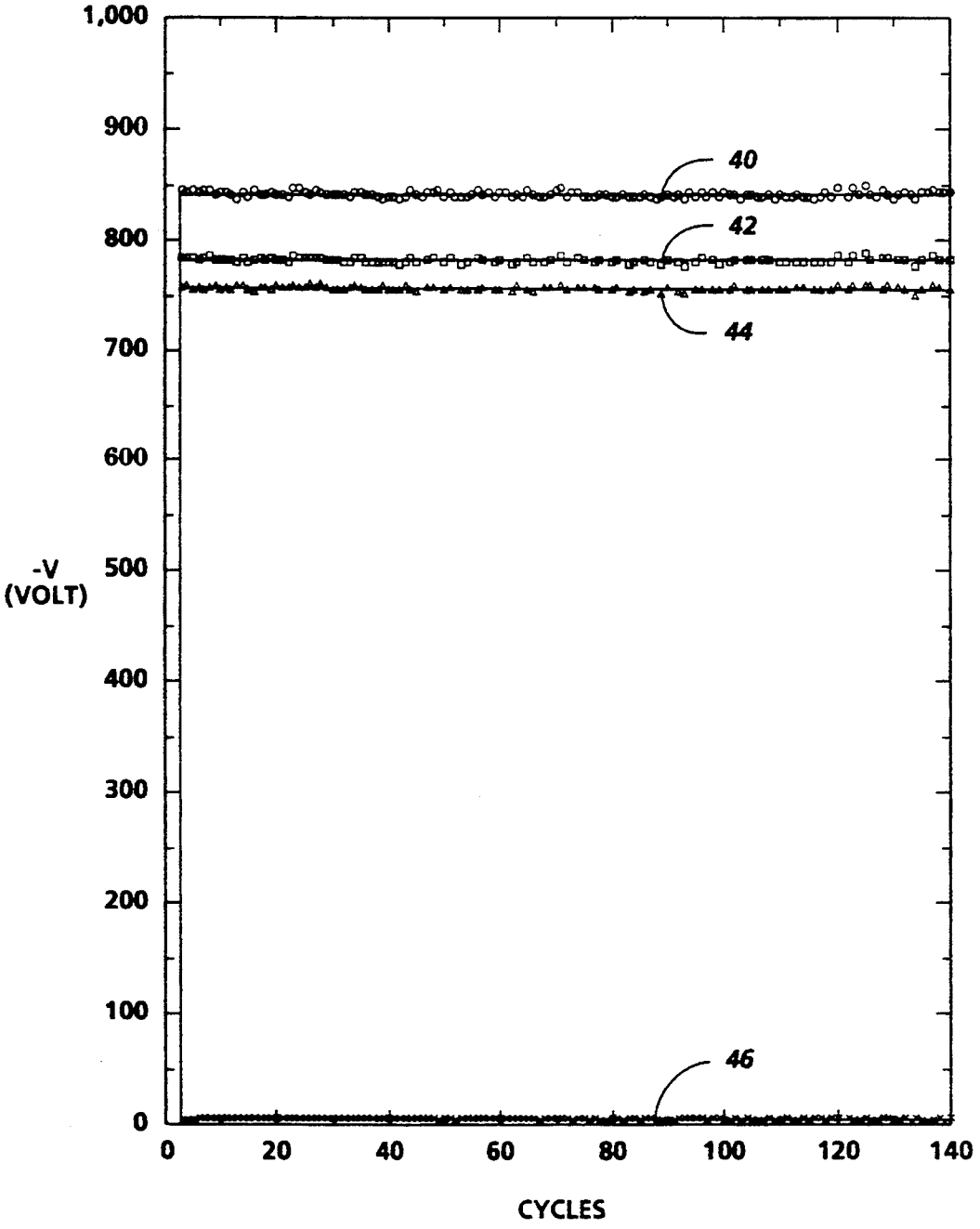
FIG. 4, 5 and 6 represent respectively: device voltage stability with cycling; dark discharge voltage after charge-erase cycling; and a photodischarge curve of a molecularly disperse pigment containing imaging members of the present invention.

FIG. 4 illustrates voltage (−V) stability with cycling of a molecularly disperse pigment containing imaging device of the present invention. For example, a device voltage with cycling is shown for four voltages, three after charging 40 (0.19 sec), 42 (0.75 sec) and 44 (1.13 sec) and one after light erasure 46 ($V_R$). As is evident from the Figure, the voltages are very stable with cycling. Random variation of less than 10 volts is due to about a 1% variation in corotron charging and systematic variations when voltage is less than 1 volt. The device was cycled through over 1,000 cumulative cycles and the voltage changed by less than 10 volts under constant charge conditions. The residual voltage ($V_R$) remained at less than 5 volts over the cumulative 1,000 cycles.

Figure 5:
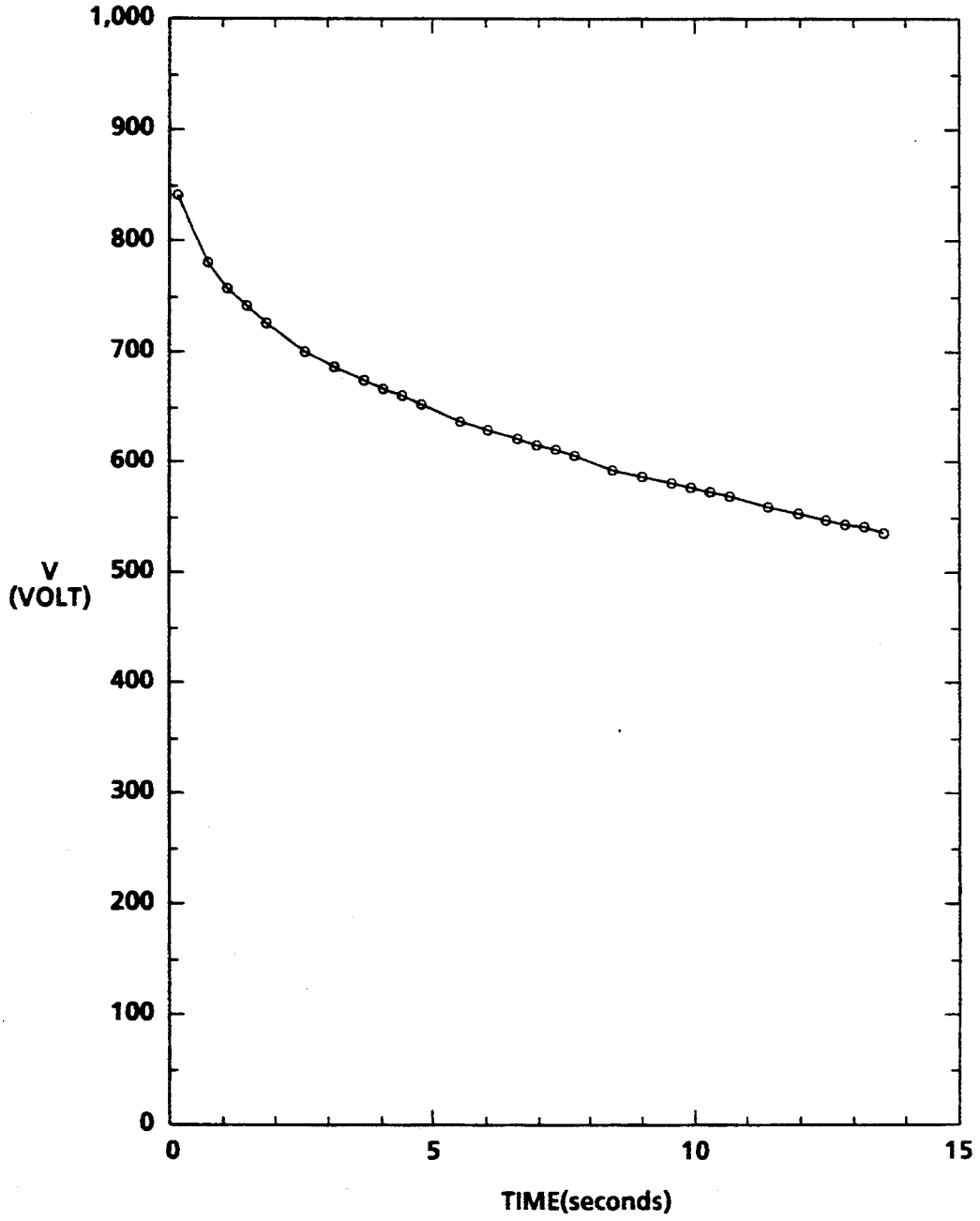

FIG. 5 illustrates typical dark discharge after charge-erase cycling, with an average dark discharge over 10 seconds of about 27 volts per second.

Figure 6:
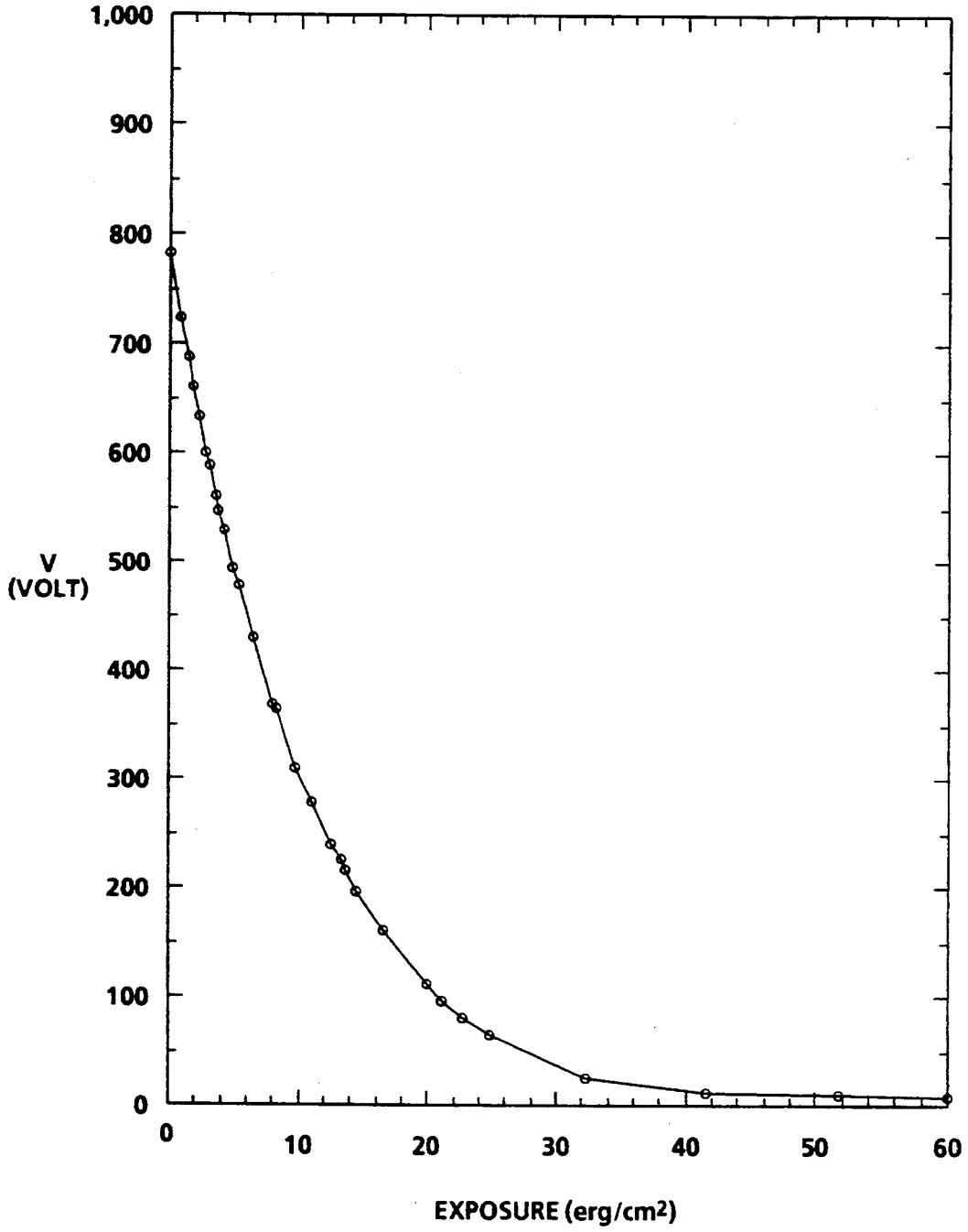

FIG. 6 illustrates a typical discharge curve of a photoconductive imaging member prepared by processes of the instant invention observed at 0.75 seconds after charging and 0.375 seconds after exposure to 670 nm light.

FIGS. 7, 8 and 9 are titanium phthalocyanine, benzimidazole perylenes, and perylene derivatives, respectively, which photoactive pigment compounds are useful in processes and imaging member embodiments of the present invention.

The supporting substrate of the imaging members may comprise an insulating material such as an inorganic or organic polymeric material, including MYLAR®, a commercially available polymer, and titanized MYLAR®; a layer of an organic or inorganic material having a semiconductive surface layer such as indium tin oxide or aluminum arranged thereon; or a conductive material such as aluminum, titanium, chromium, nickel, brass, or the like. The substrate may be flexible, seamless, or rigid and may have a number of different configurations, such as a plate, a cylindrical drum, a scroll, an endless flexible belt, and the like. In one embodiment, the substrate is in the form of an endless flexible belt. In some situations, it may be desirable to coat an anticurl layer, such as polycarbonate materials commercially available as MAKROLON® on the back of the substrate, particularly when the substrate is an organic polymeric material.

The thickness of the substrate layer depends on a number of factors, including economic considerations, the components of the other layers, and the like. Thus, this layer may be of substantial thickness, for example up to 125 mils, or of minimal thickness provided that there are no adverse effects on the resulting imaging device or process. In embodiments, the thickness of this layer is from about 3 mils to about 20 mils.

Generally, the photogenerating or photoconductive layer has a thickness of from about 0.05 micron to about 25 microns or more and preferably from 1 to about 5 microns. The thickness of the molecularly dispersed pigment containing charge generation layer is dependent primarily on the wavelength of the incident light. For example, if the xerographic imaging is done using visible light (400 to 700 nanometers range) where selected pigment compounds may be strongly absorbing, thin generation layers (about 0.2 to 2 microns) will suffice; if near infrared light, as produced by solid state lasers near 780 nanometers, is used for imaging, thicker generation layers (typically 5 to 30 microns) may be needed. Optionally, single layer photoconductors comprised solely of the photoactive pigments molecularly dispersed in a coating solution or molecularly dispersed in a coating solution containing a soluble polymer binder can be used. Generally, it is desirable to provide this layer in a thickness sufficient to absorb a substantial amount, for example, from about 80 to about 90 percent or more, of the incident radiation which is directed upon it in the imagewise or printing exposure step. The maximum thickness of this layer is also dependent upon factors such as mechanical considerations, the thicknesses of the other layers, and whether a flexible photoconductive imaging member is desired.

The charge transport layer can be comprised of various components providing, for example, that they effectively transport charges (holes) such as an aryl amine compound dispersed in a resinous binder and other components, reference the aforementioned '773 patent, and U.S. Pat. 4,933,245, the disclosure of which is totally incorporated herein by reference. In one embodiment, the charge charge transport layers are comprised of aryl amine compounds of the formula:

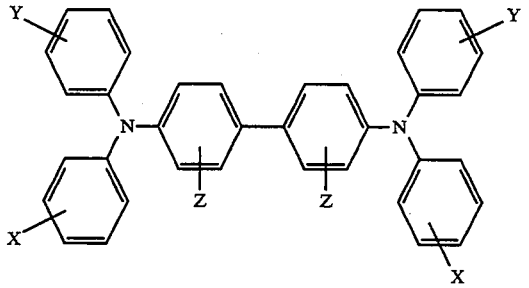

wherein X, Y and Z are selected from the group consisting of hydrogen, an alkyl group with, for example, from 1 to about 25 carbon atoms such as methyl, ethyl, propyl, isopropyl, and the like, and a halogen preferably chlorine, and at least one of X, Y and Z is independently an alkyl group or chlorine. When Y and Z are hydrogen, the amine is N,N'-diphenyl-N,N'-bis(alkylphenyl)-[1,1'-biphenyl]-4,4'-diamine wherein the alkyl is, for example, methyl, ethyl, propyl, n-butyl, or the like, or N,N'-diphenyl-N,N'-bis(chlorophenyl)-[1,1'-biphenyl]-4,4'-diamine. Preferably, X is selected from the group consisting of methyl, chloride and hydroxy in either the ortho, meta, or para positions. Suitable inactive binder materials for the hole transport layer include known highly insulating resins, which generally have a resistivity of at least 1042 ohm-cm to prevent undue dark decay. Compounds corresponding to the above formula include N,N'-diphenyl-N,N'-bis(alkylphenyl)-[1,1'-biphenyl]-4,4'-diamine, wherein alkyl is selected from the group consisting of methyl, such as 2-methyl, 3-methyl and 4-methyl, ethyl, propyl, butyl, hexyl, and the like. With halo substitution, the amine is N,N'-diphenyl-N,N'-bis(halo phenyl)-[1,1'-biphenyl]-4,4'diamine, wherein halo is 2-chloro, 3-chloro or 4-chloro. Other electrically active small molecules that can be dispersed in the electrically inactive resin to form a layer which will transport holes include bis(4-diethylamino-2-methylphenyl)phenyl methane, 4',4''-bis(-diethylamino)-2',2''-dimethyltriphenyl methane, bis-4-(diethylaminophenyl)phenyl methane, and 4,4'-bis(diethylamino)-2,2'-dimethyltriphenyl methane. Generally, the hole transport layer has a thickness of from about 5 to about 75 microns, and preferably of from about 10 to about 40 microns.

Charge transport layers are well known in the art. Typical transport layers are described, for example, in U.S. Pat. Nos., 4,265,990; 4,609,605; 4,297,424 and 4,921,773, the disclosures of each of these patents being totally incorporated herein by reference. Organic charge transport materials can also be employed. Typical charge, especially hole transporting materials include the following:

Hole transport molecules of the type described in U.S. Pat. Nos. 4,306,008; 4,304,829; 4,233,384; 4,115,116; 4,299,897 and 4,081,274, and 5,139,910 the disclosures of each of which are totally incorporated herein by reference, can be selected for the imaging members of the present invention. Typical diamine hole transport molecules include N,N'-diphenyl- N,N'-bis(3-methylphenyl)-(1,1'-biphenyl)-4,4'-diamine, and the like.

Pyrazoline transport molecules as disclosed in U.S. Pat. Nos. 4,315,982; 4,278,746 and 3,837,851, the disclosures of each of which are totally incorporated herein by reference, can also be selected in embodiments.

Substituted fluorene charge transport molecules as described in U.S. Pat. No. 4,245,021, the disclosure of which is totally incorporated herein by reference, can also be selected in embodiments.

Oxadiazole transport molecules, such as 2,5-bis(4-diethylaminophenyl)-1,3,4-oxadiazole, pyrazoline, imidazole, triazole, and the like may also be selected as charge transport molecules in embodiments. Other typical oxadiazole transport molecules are described, for example, in German Patents 1,058,836; 1,060,260 and 1,120,875, the disclosures of each of which are totally incorporated herein by reference, can also be selected in embodiments.

Other specific hole transports include hydrazone transport molecules, such as p-diethylamino benzaldehyde-(diphenylhydrazone), 4-methoxynaphthlene-1-carbaldehyde, 1-methyl-l-phenylhydrazone, and the like. Other typical hydrazone transport molecules are described, for example, in U.S. Pat. Nos. 4,150,987; 4,385,106; 4,338,388; 4,387,147; 4,256,821 and 4,297,426, the disclosures of each of which are totally incorporated herein by reference. Other specific transport molecules are described in U.S. Pat. Nos. 3,895,944; 3,820,989 and 3,870,516, the disclosures of which are totally incorporated herein by reference.

Other useful charge transport materials that may be selected, it is believed, include those described in the following patents, the disclosures of which are incorporated by reference in their entirety: U.S. Pat. No. 4,806,443, U.S. Pat. No. 4,818,650, U.S. Pat. No. 4,806,444, U.S. Pat. No. 4,935,487, U.S. Pat. No. 4,956,440, U.S. Pat. No. 4,801,517, U.S. Pat. No. 5,028,687, and U.S. Pat. No. 5,030,532.

Still another class of charge transporting polymers are represented by the polysilylene formula:

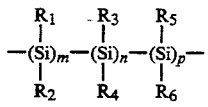

wherein $R_1$, $R_2$, $R_3$, $R_4$, $R_5$, and $R_6$ are independently selected from the group consisting of alkyl, aryl, substituted alkyl, substituted aryl, and alkoxy; and m, n, and p are numbers that reflect the percentage of the particular monomer unit in the total polymer composition with the sum of m plus n plus p being equal to 100 percent, for example, as described in U.S. Pat. No. 4,839,451, the disclosure of which is incorporated herein by reference in its entirety.

Some illustrative examples of the polysilylene transport layers include poly(methylphenyl silylene), poly(methylphenyl silylene-co-dimethyl silylene), poly(cyclohexylmethyl silylene), poly(tertiarybutylmethyl silylene) poly(phenylethyl silylene), and the like, which polysilylenes generally have a weight average molecular weight of from about 100,000 to about 2,000,000.

Examples of highly insulating and transparent resinous components or inactive binder resinous material for the transport layer include materials such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. The materials most preferred as electrically inactive resinous materials in embodiments of the present invention are poly(4,4'-dipropylidinediphenyline carbonate) with a weight average molecular weight of from about 35,000 to about 40,000, available as LEXAN 145 TM; poly(4,4'isopropylidine-diphenyline carbonate) with a weight average molecular weight of from about 40,000 to about 45,000, available as LEXAN 141 TM; a polycarbonate resin having a weight average molecular weight of from about 50,000 to about 100,000, available as MAKROLON®; and a polycarbonate having a weight average molecular weight of from about 20,000 to about 50,000, available as MERLON TM. Generally, the resinous binder contains from about 10 to about 75 percent by weight of the active material corresponding to the foregoing formula, and preferably from about 35 percent to about 50 percent of this material.

The photoconductive imaging member may optionally contain a hole blocking layer situated between the supporting substrate and the photogenerating layer. This layer may comprise metal oxides, such as aluminum oxide and the like, or materials such as silanes, nylons, and the like. The primary purpose of this layer is to prevent hole injection from the substrate during and after charging. Typically, this layer is of a thickness of about 5 to about 300 Angstroms, although it may be as thick as 2 microns in some instances.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone, and the like. Typically, this layer is, for example, of a thickness of less than about 0.6 micron with a thickness range of from about 0.05 to about 1 micron being suitable in embodiments of the present invention.

Photosensitivity values ($E_{0.5ddp}$ at 750 nanometers) for the imaging members of the present invention in embodiments thereof are acceptable and in some instances excellent, and can be, for example, from about 2 to about 25 ergs per square centimeter. Acceptable photosensitivity values vary depending on the design of the imaging apparatus in which the imaging members are contained; thus, in some instances, values as high as 40 or 50 are acceptable, and values of less than about 5 may be preferred.

Although not wishing to be limited by theory, it is believed that the high sensitivities observed, in embodiments, particularly in the infrared region, with imaging members of the present invention derive from pigment crystal packing which is similar to that packing obtained in vacuum deposition processes.

The present invention also encompasses a method of generating images with the photoconductive imaging members disclosed herein. The method comprises the steps of generating an electrostatic image on a photoconductive imaging member of the present invention, subsequently developing the electrostatic image with known developer compositions comprised of resin particles, pigment particles, additives, including charge control agents and carrier particles, reference U.S. Pat. Nos. 4,558,108; 4,560,535; 3,590,000; 4,264,672; 3,900,588 and 3,849,182, the disclosures of each of these patents being totally incorporated herein by reference, transferring the developed electrostatic image to a suitable substrate, and permanently affixing the transferred image to the substrate. Development of the image may be achieved by a number of methods, such as cascade, touchdown, powder cloud, magnetic brush, and the like. Transfer of the developed image to a substrate may be by any method, including those wherein a corotron or a biased roll is selected. The fixing step may be performed by means of any suitable method, such as flash fusing, heat fusing, pressure fusing, vapor fusing, and the like.

The processes of the present invention for preparing molecularly dispersed pigment loaded generator layer thin films enables: molecularly disperse solvent coating of solubilized pigments using conventional coating technology; control of pigment particle size and the elimination of pigment agglomeration; purification of the pigment or pigment mixture by way of a dissolution step upon complexation and subsequent filtration steps; and chemical analysis of molecularly pigment layers may be accomplished using, for example, known thin film spectroscopic techniques.

By the term "molecularly dispersed" is meant that, in embodiments, the pigment containing generator layer exhibits essentially a homogeneous or uniform distribution of individual pigment molecules with little or no agglomeration or aggregation of pigment molecules into larger particulate entities leading to a non-homogeneous distribution of pigment molecules.

A random sampling and X-ray diffraction analysis of molecularly dispersed pigment thin films prepared in the present invention indicated that no particulate or crystalline bodies greater than about 50 to 100 Angstroms were detectable.

Analysis of thin films prepared by the processes of the present invention using energy dispersive X-ray analysis (EDXA) typically detected the presence of residual ionic species derived from the solvolytic decomposition or hydrolysis of the Lewis acid complexing agent. The amount of residual species remaining and detectable in thin films prepared from Lewis acid-pigment complex solutions of the present invention appears to depend on several process and device variables, for example, solubility of ionic species resulting from solvolysis and washing of the film, concentration of the Lewis acid-pigment complex used, film thickness, extent of washing, aprotic and protic solvents selected, and the like Residual ionic products detected using EDXA ranged from a lower detection limit of about 100 counts (which corresponds to greater than or equal to about 2,000 ppm) in the case of repeated copious washings of the thinnest films prepared to about 110–200 counts for aluminum species in the case of unwashed or rapid single washed samples. Thus, depending on the aforementioned process and device variables selected it is possible to control the residual ionic species product content to a high degree of reproducability and certainty. Representative measurements are given in the working Examples, Table 6, for devices 5, 6 and 7 along with control data for devices prepared by known sublimation and dispersion coating methodologies.

High purity aluminum chloride and anhydrous nitromethane were from Aldrich Chemical Co., and reagent grade methylene chloride, tetrahydrofuran, and cyclohexanone solvents were from Fisher Scientific. MAKROLON® resin having molecular weight from about 50,000 to 100,000 All reagents were used as received without further purification. PV Fast Blue, a copper phthalocyanine, Permanent Yellow FGL, an azo pigment, and Hostaperm Pink E, a quinacridone pigment, were obtained from Hoechst. Aqueous W404 resin solution (40 weight percent) was from Witco Corp.

A transport layer coating solution was prepared as follow A mixture of N,N'-diphenyl-N,N'-bis(3-methyiphenyl)-[1,1'-biphenyl]-4,4'diamine (5 gram), MAKROLON® (5 gram) and methylene chloride (56.5 gram) in an amber bottle was roll milled until complete solubilization of the solid. An under-coat layer solution of W404 was prepared by mixing an aqueous 40 weight percent W404 solution (1 gram), tetrahydrofuran (69.3 gram), cyclohexanone (29.7 gram). All layer coatings were accomplished by a Gardner mechanical driven film applicator which is enclosed in a plexiglass acrylic box with an attached cover. Bird film applicators (7.5 inches long) of different sizes were used to achieve desirable film thicknesses. MYLAR®(75 microns) substrates with Ti-Zr alloy coatings of 200–300 Angstroms were from Imperial Chemical Industries. Substrates were overcoated with a silane blocking layer(200–500 Angstroms derived from 2-aminopropyltriethoxysilane) and then an adhesive undercoat layer (200–500 Angstroms) of PE100 or 49K (both available from DuPont). The resulting substrates were named and identified as "PE 100/silane blocking layer/Ti-Zr/MYLAR®" and "49K/Ti-Zr/silane blocking layer/MYLAR®", respectively. The W404 coating solution was used to coat a thin W404 layer (200–500 Angstroms) on the silane blocking layer/Ti-Zr/MYLAR® substrates with a size 0.0005 Bird film applicator, followed by drying at 100° C., in a forced air oven for 30 minutes to give "W404/silane blocking layer/Ti-Zr/MYLAR®" substrates. All the pigment complex solutions were prepared in a glove box under nitrogen atmosphere. Pigment layer coatings were performed under ambient condition using the Gardner film applicator.

Imaging members of the present invention exhibit excellent xerographic properties in embodiments thereof. For example, values for dark development potential ($V_{ddp}$) can range from about 200 volts to about 1000 volts of either polarity. The polarity is negative provided that the aforementioned hole transporting layers are used in conjunction with the charge generating layer is sandwiched between between the transport layer and the grounded electrode, or is positive provided that the aforementioned hole transporting layers are used in conjunction with the molecularly dispersed charge generating pigments in an inverted mode wherein the hole transporting layer is sandwiched between the charge generating layer and the substrate material, or either polarity if the charge generating pigment layer is used as a single layer photoconductor. Preferred ranges for dark development potential for the imaging members of the present invention are usually from about 200 to about 1000 volts, with 800 volts being preferred in embodiments. High dark development potentials permit high contrast potentials, which result in images of high quality with essentially no background development.

The imaging members of the present invention in embodiments thereof also exhibit low dark decay values of, for example, about 50 volts per second or less. Low dark decay values are of importance for developing high quality images since dark decay measures the amount of charge that disappears after charging of the photoreceptor, and a large difference in charge between exposed and unexposed areas of the photoreceptor results in images with high contrast. Furthermore, low dark discharge leads to more stable voltages with changes in temperature and cycling. Acceptable values for dark decay vary depending on the design of the imaging apparatus in which the imaging members are contained. Dark decay may be as high as 100 volts per second with 50 volts and 10 to 20 volts per second being preferred in embodiments.

Residual potential values ($V_R$) for the imaging members of the present invention in embodiments thereof are excellent, ranging from, for example, about 1 volt to about 20 volts. Residual potential is a measure of the amount of charge remaining on the imaging member after erasure by exposure to flooding light and prior to imaging. Residual potentials of 5 to 15 volts are considered exceptional and preferred.

Photosensitivity values (slope of discharge S in volts per ergs per square centimeter or exposure (Exp) required to discharge from 800 to 100 volts in ergs per square centimeter) for the imaging members of the present invention in embodiments thereof are acceptable and in some instances excellent, and can be, for example, from about 20 to about 50 ergs per square centimeter. Acceptable photosensitivity values vary depending on the design of the imaging apparatus in which the imaging members are contained; thus, in some instances, light exposure values as high as 40 or 50 are acceptable, and values of less than about 10 may be preferred.

The following Examples are being supplied to further define various species of the present invention, it being noted that these Examples are intended to illustrate and not limit the scope of the present invention. Parts and percentages are by weight unless otherwise indicated.

EXAMPLE I

Pgment/aluminum chloride complex solutions were prepared by magnetic stirring a mixture of a pigment, aluminum chloride ($AlCl_3$) and nitromethane or a mixed solvent of nitromethane and methylene chloride in capped 20 ml vials in a glove box under nitrogen atmosphere for 12 to 16 hours at room temperature. A set of pigment solutions was prepared with compositions summarized in Table 1. The molar ratio of the pigment to $AlCl_3$ was 1:6 in all situations. These solutions had about 2 weight percent of pigment and were easily passed through 0.45 micrometer filters. A solution 7, not shown in Table 1, containing a mixture of pigments was prepared by mixing 2 grams of filtered solutions 1 and 6, to give a solution containing about 1 weight percent each of benzimidazole perylene and titanyl phthalocyanine. Selected filtered solutions were used to solvent coat the pigmented layers as described in Example II.

TABLE 1

Compositions for pigment/aluminum chloride solutions

| pigments & reagents | soln. 1 | soln. 2 | soln. 3 | soln 4 | soln 5 | soln 6 |
|---|---|---|---|---|---|---|
| TiOPc | 0.26 | — | — | — | — | — |
| VOPc | — | 0.26 | — | — | — | — |
| PV Fast Blue (grams) | — | — | 0.29 | — | — | — |
| Permanent Yellow (grams) | — | — | — | 0.30 | — | — |
| Hostaperm Pink E (grams) | — | — | — | — | 0.17 | — |
| benzimidazole perylene (grams) | — | — | — | — | — | 0.26 |
| $AlCl_3$ (grams) | 0.39 | 0.39 | 0.39 | 0.39 | 0.39 | 0.39 |
| nitromethane (mL) | 8 | 8 | 10 | 10 | 10 | 8 |
| methylene chloride (mL) | 2 | 2 | — | — | — | 2 |

EXAMPLE II

Table 2 summarizes the fabrication parameters for five devices using selected filtered solutions given in Example I and Table 1. Three types of substrates, namely W404/SBL/Ti-Zr/MYLAR®, PE100/SBL-/Ti-Zr/MYLAR® and K/SBLFFi-Zr/MYLAR® were used for the device preparation. MYLAR® films (75 micrometers) with Ti-Zr alloy coatings of 200–300 Angstroms were overcoated with a silane, 2-aminopropyltriethoxysilane,-blocking layer (SBL) (200–500 Angstroms) and then an adhesive undercoat layer (200–500 Angstroms) of polyester PE100 or 49K (both available from DuPont) to give PE100/SBL/Ti-Zr/MYLAR® or 49K/SBL/Ti-Zr/MYLAR® substrates, respectively. The W404 coating solution was prepared by mixing an aqueous 40 weight percent W404 solution, available from Witco Corp. (1 gram), tetrahydrofuran (69.3 gram), cyclohexanone (29.7 gram). The W404 coating solution was used to coat a thin W404 layer (200–500 Angstroms) on SBL/Ti-Zr/MYLAR® substrates with a size 0.0005 Bird film applicator, followed by drying at 100° C. in a forced air oven for 30 minutes to give W404 /SBL/Ti-Zr/MYLAR® substrates. The preparation procedure for devices 1 and 4 are given below in representative procedures. A PE100/SBL/Ti-Zr/MYLAR® substrate was placed on the vacuum plate of the Gardner coater and a size 0.0005 Bird film applicator was placed on top of the substrate. About 1 mL of pigment solution 1 was applied with a pipet along the Bird film applicator onto the substrate. A plexiglass dust cover was placed over a coating box prior to coating. After solvent evaporation (about 2–3 minutes)in the enclosed box, the coated substrate was hung in a fume hood for 30 minutes at ambient temperature and then placed in a tray of tap water for 5 minutes to hydrolyze complexed and unreacted $AlCl_3$. The washed film was air dried and was then coated, using a 0.003 size Bird film applicator in the enclosed coating box, with a transport layer using a solution prepared as follows: a mixture of N,N'-diphenyI-N,N'-bis(3-methylphenyl)-[1,1'-biphenyl]-4,4'-diamine (5 gram), MAKROLON® (5 gram) and methylene chloride (56.5 gram) in an amber bottle was roll milled until complete solubilization of the solid occurred. The resulting device was dried in a forced air oven at 100° C. for 30 minutes. The thickness of the pigment and transport layers were measured to be about 0.3–0.5 micrometers, by a transmission electron microscope (TEM), and 17.0 micrometers, measured by a micrometer, respectively. Device 4 was fabricated similarly by first depositing a titanyl phthalocyanine/$AlCl_3$ complex layer using solution 1. After solvent evaporation, a second benzimidazole perylene/$AlCl_3$ layer was coated thereon using solution 6. This was followed by water washing, air drying, transport layer coating and oven drying to give device 4. The scanning electron micrographs (SEM) of the pigment layers showed images that were highly coherent and film-like with no detectable individual pigment particles, indicating very high degrees of uniformity for the molecularly dispersed pigment layers.

TABLE 2

| pigments & reagents | Device fabrication parameters and device description | | | | |
|---|---|---|---|---|---|
| | device 1 | device 2 | device 3 | device 4 | device 5 |
| pigment solution(s) | 1 | 2 | 7 | 1 and 6 | 6 and 1 |
| substrate* | A | A | B | B | B |
| Bird applicator for pigment coatings | 0.0005 | 0.0005 | 0.0005 | 0.0005 | 0.0005 |
| water washing time (min) | 5 | 5 | 5 | 5 | 5 |
| Bird applicator for transport layer coatings | 0.003 | 0.003 | 0.003 | 0.003 | 0.003 |
| thickness of pigment layer (microns) | 0.3–0.5 | 0.3–0.5 | 0.3–0.5 | 0.5–0.7 | 0.5–0.7 |
| thickness of transport layer (microns) | 17.0 | 17.0 | 17.0 | 17.0 | 17.0 |

*A = PE 100/SBL/Ti-Zr/MYLAR ®; B = W404/SBL/Ti-Zr/MYLAR ®

EXAMPLE III

Benzimidazole perylene/aluminum chloride ($AlCl_3$) solutions were prepared by magnetic stirring a mixture of benzimidazole perylene, aluminum chloride and nitromethane or a mixed solvent of nitromethane and methylene chloride in 20 ml vials in a glove box under nitrogen atmosphere for 12 to 16 hours. Table 3 summarizes the compositions for seven representative pigment solutions. The molar ratio of benzimidazole perylene to aluminum chloride was 1:6 for solutions 8 to 13 and 1:4 for solution 14. Solutions 8, 9 and 14, having about 2 weight percent of solubilized pigment, were easily filtered through 0.45 micrometer filters; but solutions 10 to 13 with higher pigment concentrations could not be easily filtered. This indicated that benzimidazole perylene can almost be completely solubilized at about 2 weight percent and that benzimidazole perylene-/$AlCl_3$ complex may form aggregates at higher pigment concentrations. All solutions shown in Table 1 were suitable for coating of benzimidazole perylene layers, as described in Example IV.

TABLE 3

| pigment & reagents | Compositions of benzimidazole perylene/$AlCl_3$ solutions | | | | | | |
|---|---|---|---|---|---|---|---|
| | soln. 8 | soln. 9 | soln. 10 | soln. 11 | soln. 12 | soln. 13 | soln. 14 |
| benzimidazole perylene (gram) | 0.26 | 0.26 | 0.39 | 0.52 | 0.78 | 0.78 | 0.26 |
| $AlCl_3$ (gram) | 0.39 | 0.39 | 0.59 | 0.78 | 1.17 | 1.17 | 0.26 |
| nitromethane (ml) | 10 | 6 | 6 | 6 | 5 | 8 | 10 |
| methylene chloride (ml) | — | 4 | 4 | 4 | 5 | 2 | — |
| 49K (gram) | — | — | — | — | — | — | 0.1 |
| benzimidazole perylene, wt % | 2.2 | 2.0 | 3.0 | 3.9 | 5.5 | 5.7 | 2.2 |

EXAMPLE IV

Table 4 summarizes the fabrication parameters for seven benzimidazole perylene containing devices prepared from the unfiltered benzimidazole perylene-/$AlCl_3$ solutions given in Example III. The preparation procedure for the devices was essentially identical to that described in Example II. However, the pigment layers for device 6 and 7 were washed twice with water. The first wash was at room temperature with tap water and the second wash was with deionized water at 50° C. for 10 min. The scanning electron micrographs of the pigment layers showed images that were highly coherent and film-like with no detectable individual pigment particles, indicating very high degrees of uniformity for the pigment layers. The thicknesses of the pigment and transport layers for each device is also presented in Table 4.

TABLE 4

| pigments & reagents | Device fabrication parameters and device description | | | | | | |
|---|---|---|---|---|---|---|---|
| | device 1 | device 2 | device 3 | device 4 | device 5 | device 6 | device 7 |
| substrate* | B | B | A | C | A | C | C |
| pigment solution # | 9 | 9 | 12 | 11 | 11 | 12 | 12 |

TABLE 4-continued

| pigments & reagents | Device fabrication parameters and device description | | | | | | |
|---|---|---|---|---|---|---|---|
| | device 1 | device 2 | device 3 | device 4 | device 5 | device 6 | device 7 |
| (see Table 3) | | | | | | | |
| size of Bird film applicator for pigment layer coatings | 0.0005 | 0.0005 | 0.0005 | 0.001 | 0.001 | 0.002 | 0.002 |
| first water washing time (min) | 0 | 5 | 5 | 5 | 5 | 5 | 5 |
| second water washing time (min) and temp (°C.) | — | — | — | — | — | — | 10 min 50° C. |
| size of Bird film applicator for transport layer coatings | 0.003 | 0.003 | 0.003 | 0.003 | 0.003 | 0.004 | 0.004 |
| thickness of pigment layer (microns) | 0.3–0.5 | 0.3–0.5 | 0.3–0.5 | 0.64 ± 0.16 | — | 1.35 ± 0.17 | — |
| thickness of transport layer (microns) | 17.0 | 17.0 | 17.0 | 17.0 | 17.0 | 23.0 | 23.0 |

*A = PE 100/SBL/Ti-Zr/MYLAR ®;
B = W404/SBL/Ti-Zr/MYLAR ®;
C = 49K/SBL/Ti-Zr/MYLAR ®.

EXAMPLE V

ELECTRICAL EVALUATION.

Xerographic measurements were accomplished on a rotating drum scanner using 3 inch by 4 inch samples of the imaging member prepared as described herein. The samples were charged with a negative corona under constant current charging conditions as they were rotating at 20 rpm with an average charge of 105 nanocoulombs per square centimeter, which is equivalent to an electric field of 40 volts per micrometer. The surface potential of the samples was monitored with Monroe Electronics non contacting voltmeters (Model 144) placed at various positions around the circumference of the drum, corresponding to various times from charging. An exposure to monochromatic light was located 45 degrees from charging or 375 milliseconds after charging and a white light erasure located 2.531 seconds after charging and voltage probes were located to monitor the voltages after exposure and erase. The output of the voltmeters was digitized by a computer and the entire cycling test sequence was collected digitally under computer control. The monochromatic light exposure wavelengths were adjusted using first order interference filters with a 10 nanometer halfwidth and neutral density filters were used to control the intensity of the light. Both the monochromatic and neutral density filters were mounted on rotating wheels that permitted dialing in the desired wavelength and intensity by computer or manual control. The samples were cycled and FIG. 4 is an example of the device voltage with cycling, showing four voltages, three after charging and one after light erasure. As is evident in the FIG. 4, the voltages are exceptionally stable with cycling, random variation of less than 10 volts is due to 1% variation in the corotron charging and systematic variation in voltage is less than 1 volt. Over 1,000 cumulative cycles the voltage changed by less than 10 volts under constant charge conditions. The residual voltage ($V_R$) remained at less than 5 volts over the cumulative 1,000 cycles. The dark discharge was monitored by turning off the erase light and charging and observing the voltage over several cycles FIG. 5 shows a typical dark discharge, with an average dark discharge over 10 seconds of about 27 volts per second.

The photodischarge curve was obtained by opening and closing the shutter on alternate cycles and varying the intensity of the exposure light. FIG. 6 is a typical discharge curve observed 0.75 seconds after charging and 0.375 seconds after exposure to 670 nm light for device number 7. The slope of discharge(S) is 60 volts per erg per square centimeter and the light exposure (Exp) required to discharge from 800 volts to 100 volts is 21 erg per square centimeter. Measurements were also made at 630 and 780 nm and the resultant sensitivities(S) and exposures (Exp) for 700 volt discharge were 58 volts per erg per square centimeter and 16, 22 and 70 erg per square centimeter, respectively. Corresponding data of the other samples is summarized in Table 5. The residual voltage ($V_R$) and the initial voltage ($V_{0.2}$) measured at 0.2 seconds are as shown. The dark discharge values are measured in volts per second.

TABLE 5

| Device | | | Dark | 630 nm | | 670 nm | | 780 nm | |
|---|---|---|---|---|---|---|---|---|---|
| Number | $V_R$ | $V_{0.2}$ | Discharge | S | Exp | S | Exp | S | Exp |
| 5 | 5 | 885 | 15 | 30 | 37 | 32 | 35 | 9 | 170 |
| 6 | 5 | 864 | 23 | 48 | 25 | 50 | 24 | 13 | 110 |
| 7 | 4 | 845 | 27 | 58 | 22 | 60 | 21 | 16 | 70 |

The BZP layers of devices 5, 6 and 7 were examined by energy dispersive X-ray analysis (EDXA) using an X-ray beam potential of 10 kV. The results are summarized in the accompanying Table 6. The detected Ti and Zr counts indicates that X-rays penetrated through the entire BZP containing layer(s) and reached the underlying Ti-Zr layers. Integrated peak counts are given after background subtraction. Control values of EDXA data for devices prepared by way of respective known BZP sublimation and dispersion methods, that is without Lewis acid-pigment solubilization of the present invention, are given in duplicate as shown in the last to rows of Table 6. The control samples employing either sublimed or dispersed BZP were prepared using the aforementioned 49K/SBL/Ti-Zr substrates. In all control examples no Al or Cl species could be detected.

TABLE 6

| BZP layer in Device No. | Elemental Analysis by EDXA* Elements | | | | | |
|---|---|---|---|---|---|---|
| | Al counts | Cl counts | O counts | Si counts | Ti counts | Zr counts |
| device 5 | 135 | 307 | 1714 | 1695 | 664 | 2989 |
| device 6 | 126 | 549 | 1521 | 1614 | 846 | 2643 |
| device 7 | 113 | 263 | 2426 | 1682 | 1082 | 3871 |
| Sublimed BZP | 0 | 0 | 7267 | 3243 | 7002 | N.M.** |
| Control | 0 | 0 | 7910 | 3059 | 6986 | |
| Dispersed BZP | 0 | 0 | 4990 | 397 | 66 | N.M.** |
| Control | 0 | 0 | 4920 | 352 | 57 | |

*X-ray beam potential = 10 kV
**N.M. = Not measured.

Other modifications of the present invention may occur to those skilled in the art subsequent to a review of the present application, and these modifications are intended to be included within the scope of the present invention.

What is claimed is:

1. A process for preparing a photoconductive imaging member comprising: providing a solution comprised of a solubilized pigment-Lewis acid complex, a binder resin, and a polar aprotic solvent system; coating the solution onto a substrate to form a photogenerating film or coating layer containing a molecularly dispersed pigment-Lewis acid complex on the substrate; drying the film layer or coating layer; washing the dry film layer with a protic solvent system to remove the Lewis acid; drying the coated substrate; and optionally applying a charge transporting layer and or a protective overcoating layer to the coated substrate.

2. A process according to claim 1 wherein the pigment is selected from the group consisting of metal phthalocyanines, metal-free phthalocyanines, oligomeric phthalocyanines, quinacridones, benzimidazole perylenes, perylene tetracarboxyl diimides, substituted 2,4-diamino-triazines, squaraines, polynuclear aromatic quinones, thiopyrylium compounds, and mixtures thereof.

3. A process according to claim 2 wherein the pigment concentration in the solubilized pigment-Lewis acid complex containing solvent system is from about 0.005 to about 20 weight percent.

4. A process according to claim 1 wherein the Lewis acid is selected from the group consisting of $AlCl_3$, $GaCl_3$, $FeCl_3$, $InCl_3$, $SnCl_4$, $BF_3$, $ZnCl_2$, $TiCl_4$, $SbCl_3$, $SbCl_5$, $CuCl_2$, $SbF_5$, $VCl_4$, $TaCl_5$, $ZrCl_4$, $AsF_3$, and mixtures thereof.

5. A process according to claim 1 wherein the binder resin is selected from the group consisting of polycarbonates, acrylate polymers, vinyl polymers, polyvinylcarbazole, polyvinylbutyrals, polystyrene and copolymers thereof, polyesters, polysiloxanes, polyamides, polyurethanes, epoxies, and mixtures thereof.

6. A process according to claim 5 further comprising the step of removing the coating from the substrate to yield a free-standing film.

7. A process according to claim 1 wherein the aprotic solvent system is a solvent mixture of at least one organic solvent and at least one nitro orclanic solvent selected from the group consisting of methylene chloride, chloroform, trichloroethane, 1,2-dichloroethane, nitroalkanes or nitroalkenes having from 1 to 6 carbon atoms, benzene, and toluene.

8. A process according to claim 1 wherein the protic solvent system is a solvent or solvent mixture containing at least one protic solvent and is selected from the group consisting of water, methanol, ethanol, propanol, iso-propanol, acetic acid, formamide, acetone, acetonitrile, dimethylformamide, N-methyl-2-pyrrolidone, and mixtures thereof.

9. A process according to claim 1 wherein the substrate is an organic polymer.

10. A process according to claim 1 wherein coating the solubilized pigment-Lewis acid complex containing solvent system onto a substrate to form a thin film is achieved by casting, spraying, dipping, spin casting or spinning.

11. A process according to claim 1 wherein drying the coated substrate is accomplished by heating at a temperature of from about 5 to about 60° C. for 1 to about 300 minutes.

12. A process according to claim 1 wherein pigment-Lewis acid complex is comprised of a molar ratio of Lewis acid to pigment of from about 1:1 to about 20:1.

13. A process according to claim 1 wherein pigment-Lewis acid complex is comprised of a molar ratio of Lewis acid to pigment of from about 5:1 to about 10:1.

14. A process in accordance with claim 1 wherein the resulting photoconductive imaging member has a layer configuration or structure wherein: the photogenerating layer is in contact with and is situated between the supporting substrate and the charge transport layer; or the charge transport layer is in contact with and is situated between the supporting substrate and the photogenerating layer.

15. A process in accordance with claim 14 wherein the photoconductive imaging member includes a metal oxide hole blocking layer in contact with and situated between the supporting substrate and the photogenerating layer.

16. A process in accordance with claim 15 wherein the metal oxide hole blocking layer is aluminum oxide with a thickness of from between about 100 and about 500 Angstroms.

17. A process in accordance with claim 15 wherein the photoconductive imaging member contains an adhesive interface layer selected from the group consisting of polyester, polyvinylbutyral, and polyvinyl pyrrolidone in contact with and situated between the supporting substrate and the metal oxide hole blocking layer with a thickness of from between about 0.1 and 0.6 micron.

18. A process in accordance with claim 14 wherein the photogenerating layer has a thickness of from about 0.05 to about 10 microns and the charge transport layer has a thickness of from about 5 to about 50 micrometers.

19. A process in accordance with claim 14 wherein the charge transport layer is a hole transport layer comprised of an aryl amine compound:

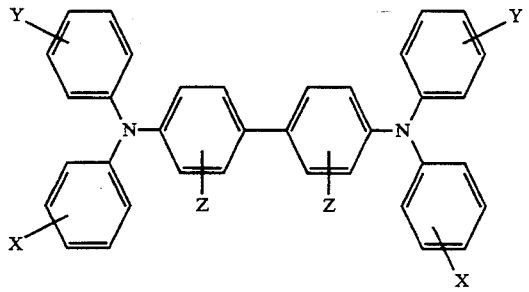

dispersed in a highly insulating and transparent organic resinous binder and wherein X, Y and Z are selected from the group consisting of hydrogen, an alkyl group with from 1 to about 25 carbon atoms and a halogen, and at least one of X, Y and Z is independently an alkyl, hydroxy, or a halogen group.

20. A process in accordance with claim 19 wherein X is selected from the group consisting of ortho ($CH_3$), meta ($CH_3$), para ($CH_3$), ortho (OH), meta (OH), para (OH), ortho (Cl), meta (Cl), and para (Cl).

21. A process in accordance with claim 19 wherein the resinous binder is a polyester, a polyvinyl butyral, a polystyrene and copolymer thereof, a polycarbonate, a polyvinyl carbazole, or a polyvinyl formal.

22. A process in accordance with claim 1 wherein the substrate is a metal or metalized polymer selected from the group consisting of aluminum, titanium, nickel, aluminized polyester, and mixtures thereof, having a thickness of from about 3 to about 100 mils.

23. A process in accordance with claim 1 further comprising optionally drying and substantially removing the Lewis acid by washing the thin film with a protic solvent.

24. A process according to claim 1 wherein pigment-Lewis acid complex is comprised of a molar ratio of Lewis acid to pigment of from about 1:1 to about 20:1.

25. A process according to claim 1 wherein pigment-Lewis acid complex is comprised of a molar ratio of Lewis acid to pigment of from about 5:1 to about 10: 1.

26. A photoconductive imaging member comprised of a supporting substrate, and a photogenerating layer in contact therewith comprised of a molecularly dispersed pigment selected from the group consisting of metal phthalocyanines, metal-free phthalocyanines, quinacridones, benzimidazole perylenes, perylene tetracarboxyl diimides, substituted 2,4-diamino-triazines, squaraines, polynuclear aromatic quinones, thiopyrylium compounds, and mixtures thereof, optionally dispersed in a binder resin, an optional charge transporting layer, and a top or a protective overcoating optional layer thereon, and wherein the molecularly dispersed pigment layer contains of from about 10 to about 10,000 parts per million residual Lewis acid content.

27. A photoconductive imaging member in accordance with claim 26 wherein said imaging member is used in, or in conjunction with, an optoelectronic device selected from the group consisting of light emitting diodes, organic electroluminescent emitters, field effect transistors, vacuum fluorescent displays, thin film transistors, and liquid crystal displays.

28. A photoconductive imaging member in accordance with claim 26 further comprising two or more adjacent photogenerating layers wherein each layer is comprised of a dissimilar molecularly dispersed pigment and an optional binder which is the same or dissimilar in each layer.

29. A photoconductive imaging member in accordance with claim 26 wherein the pigment mixture contains a first pigment of from about 1 to about 50 weight percent of the pigment mixture and a second pigment of from about 10 to about 90 weight percent of the pigment mixture.

* * * * *